US009791238B2

(12) United States Patent
Bowen

(10) Patent No.: US 9,791,238 B2
(45) Date of Patent: Oct. 17, 2017

(54) RIFLE BUTT STOCK ADJUSTMENT ACTUATOR

(71) Applicant: Daniel Lucian Bowen, Alexandria, VA (US)

(72) Inventor: Daniel Lucian Bowen, Alexandria, VA (US)

( * ) Notice: Subject to any disclaimer, the term of this patent is extended or adjusted under 35 U.S.C. 154(b) by 0 days.

(21) Appl. No.: 15/232,478

(22) Filed: Aug. 9, 2016

(65) Prior Publication Data

US 2017/0059271 A1 Mar. 2, 2017

Related U.S. Application Data

(60) Provisional application No. 62/204,923, filed on Aug. 13, 2015.

(51) Int. Cl.
*F41C 23/04* (2006.01)
*F41C 23/14* (2006.01)

(52) U.S. Cl.
CPC ..... *F41C 23/04* (2013.01); *F41C 23/14* (2013.01)

(58) Field of Classification Search
CPC ..... F41C 23/04; F41C 23/14
USPC ..... 42/73
See application file for complete search history.

(56) References Cited

U.S. PATENT DOCUMENTS 3,137,958 A * 6/1964 Lewis ..... F41C 23/14 42/73
3,348,328 A * 10/1967 Roy ..... F41C 23/04 42/73
4,327,626 A * 5/1982 McQueen ..... F41A 3/54 42/72
6,779,289 B2 * 8/2004 Kay ..... F41C 23/22 42/72
7,322,142 B1 * 1/2008 Leung ..... F41C 23/04 42/71.01
D620,067 S * 7/2010 Saur ..... F41C 23/04 D22/108
7,762,018 B1 * 7/2010 Fitzpatrick ..... F41A 11/02 42/73
7,849,626 B2 * 12/2010 Fluhr ..... F41C 23/04 42/73
D640,342 S * 6/2011 Fitzpatrick ..... D22/108
D661,366 S * 6/2012 Zusman ..... F41C 23/04 D22/108

(Continued)

*Primary Examiner* — Joshua E Freeman
(74) *Attorney, Agent, or Firm* — Law Office of Oliver Edwards LLC

(57) ABSTRACT

A rifle butt stock adjustment actuator having a body with a U-channel configured to fit a base of a telescoping rifle butt stock and operably connect to a butt stock adjustment mechanism is disclosed. The actuator includes a "push" pair of ergonomically shaped finger pressure surfaces disposed on the body and a "pull" pair of ergonomically shaped finger pressure surfaces disposed on the body. When attached to the base of a telescoping rifle butt stock and operably connected to the butt stock adjustment mechanism, pressure applied to the push pair of pressure surfaces actuates the butt stock adjustment mechanism and telescopes the rifle butt stock into a shorter configuration. Pressure applied to the pull pair of pressure surfaces actuates the butt stock adjustment mechanism and telescopes the rifle butt stock into a shorter configuration. Push and pull actuation may include both a torque and translation force.

12 Claims, 4 Drawing Sheets

(56) References Cited

U.S. PATENT DOCUMENTS

D668,311 S * 10/2012 Rogers ..... F41C 23/04 D22/108
8,341,868 B2 * 1/2013 Zusman ..... F41C 23/22 42/73
8,434,252 B2 * 5/2013 Holmberg ..... F41A 3/84 42/1.06
8,474,169 B2 * 7/2013 Cottle ..... F41C 23/04 42/73
D706,879 S * 6/2014 Chu ..... D21/573
8,800,189 B2 * 8/2014 Fitzpatrick ..... F41C 23/06 42/71.01
D722,357 S * 2/2015 Keller ..... D22/108
D722,669 S * 2/2015 Keller ..... D22/108
8,978,284 B1 * 3/2015 Zusman ..... F41C 23/22 42/1.06
8,978,285 B1 * 3/2015 Burke ..... F41C 23/14 42/73
8,984,791 B1 * 3/2015 Leslie ..... F41C 23/04 42/71.01
D738,981 S * 9/2015 Zusman ..... D22/108
9,261,324 B1 * 2/2016 Liang ..... F41C 23/04
9,551,549 B1 * 1/2017 Chvala ..... F41C 23/14
9,612,083 B2 * 4/2017 Cottle ..... F41C 23/14
2002/0050088 A1 * 5/2002 Sharp ..... F41A 23/10 42/73
2003/0101631 A1 * 6/2003 Fitzpatrick ..... F41C 23/04 42/72
2004/0031182 A1 * 2/2004 Bentley ..... F41C 23/04 42/74
2006/0254111 A1 * 11/2006 Giauque ..... F41C 23/14 42/72
2007/0101631 A1 * 5/2007 Bentley ..... F42B 39/02 42/74
2010/0242328 A1 * 9/2010 Faifer ..... F41C 23/06 42/1.06
2010/0242333 A1 * 9/2010 Kincel ..... F41C 23/04 42/73
2011/0173863 A1 * 7/2011 Ingram ..... F41A 11/00 42/73
2011/0283584 A1 * 11/2011 Walters ..... F41C 23/04 42/73
2012/0174456 A1 * 7/2012 DePierro ..... F41C 23/22 42/71.01
2013/0097911 A1 * 4/2013 Larue ..... F41C 23/04 42/73
2013/0180148 A1 * 7/2013 Rogers ..... F41C 23/04 42/73
2016/0178314 A1 * 6/2016 Kielsmeier ..... F41C 23/14 42/73
2016/0187099 A1 * 6/2016 Cottle ..... F41C 23/14 42/73
2016/0202016 A1 * 7/2016 Mather ..... F41C 23/14 42/73
2016/0273875 A1 * 9/2016 Cottle ..... F41C 23/10
2016/0327362 A1 * 11/2016 Eitan ..... F41C 23/02

* cited by examiner

--PRIOR ART--

--PRIOR ART--

--PRIOR ART--

--PRIOR ART--

RIFLE BUTT STOCK ADJUSTMENT ACTUATOR

This application claims the benefit of U.S. provisional application Ser. No. 62/204,923 filed Aug. 13, 2015, the entire contents of which are hereby incorporated for all purposes.

BACKGROUND

Field of the Invention

The present invention generally relates to an actuator for rifle butt stock adjustment for shoulder fired firearms and more particularly concerns adjustable butt stock mechanisms that enable firearm users to establish rapid and precision adjustment of the length of a rifle as desired for a comfortable fit of a firearm stock with the anatomy of the user and conditions—e.g., in the event close quarter combat conditions warrant the use of a rather short and compact shoulder fired weapon. Such firearms may include rifles such as the AR15, M16 and M4.

Description of the Related Art

U.S. Pat. No. 3,348,328 to Roy teaches a mechanism for an extendible, telescoping rifle butt stock. A butt stock body and lower receiver extension are axially movable with respect to each other by movement of the lower receiver extension in the bore of the butt stock body. Roy teaches that a spring-loaded lock pin holds the rifle butt stock at a particular length. To change the length, the user must first disengage the lock pin by squeezing a lever upward toward the base of the butt stock or pulling the lever down away from the butt stock while simultaneously sliding the butt stock relative to the lower receiver extension with a relative pull or push force. The squeeze action cannot practically be carried out while the weapon is in a firing or ready position. The pull-down action risks pinching the user or entrapping the user's glove when the lever is returned to the lock pin engaged position and also requires an unnatural, forced underhand grasp of the lever.

U.S. Pat. No. 8,474,169 to Cottle discloses a cammed lock pin disengaging mechanism which the operator must rotate left or right about a vertical axis. Once the lock pin is disengaged, the stock length can be changed by sliding the buffer tube relative to the butt stock. The buffer tube is locked in place again when the operator rotates the disengaging mechanism left or right back to the lock position. The locking, length change and relocking is not easily carried out while the rifle is in the firing or ready position.

In one prior art implementation, see FIG. 4, a lever 44 in a hollow of butt stock 11, may be squeezed, thereby pulling lock pin mechanism 55 downward and disengaging a lock pin from the buffer tube 2. While squeezing, the operator must push or pull the butt stock relative to the rest of the rifle and then release the lever to lock the butt stock in position on the buffer tube. The squeeze action and push or pull actions cannot practically be carried out while the weapon is in a firing or ready position and the user cannot easily maintain a consistent sight picture.

Accordingly, there is a need to overcome the shortcomings of these prior devices to promote a consistent sight picture and ability to extend and retract the butt stock while keeping the rifle steady and in a sighting or firing position.

SUMMARY OF INVENTION

In an exemplary embodiment of the present invention, there is provided a rifle butt stock adjustment actuator having a body with a U-shaped channel configured to fit a base of a telescoping rifle butt stock and operably connect to a butt stock adjustment mechanism. The actuator includes a "push" pair of ergonomically shaped finger pressure surfaces disposed on the body and a "pull" pair of ergonomically shaped finger pressure surfaces disposed on the body. When attached to the base of a telescoping rifle butt stock and operably connected to the butt stock adjustment mechanism, pressure applied to the push pair of pressure surfaces actuates the butt stock adjustment mechanism and permits telescoping of the rifle butt stock into a shorter configuration. Pressure applied to the pull pair of pressure surfaces actuates the butt stock adjustment mechanism and permits telescoping of the rifle butt stock into a shorter configuration.

In some embodiments a rear one of the pull pair of pressure surfaces is indented into the body. In some embodiments the size and shape of the ergonomically shaped finger pressure surfaces are optimized for one of a left hand or a right hand. In some embodiments a front one of the pull pair of pressure surfaces terminates in a forward-edge lip. In some embodiments the pressure surfaces comprise an anti-slip surface treatment. In some embodiments the anti-slip surface treatment is surface knurling. In some embodiments there is at least one pressure surface comprising a tactile feature for identifying the surface by feel.

In another embodiment, an unlock actuator/adjuster for an adjustable length rifle butt stock is provided. The actuator/adjuster has a body operably connected to a rifle butt stock length adjuster lock with at least one "lengthen" surface upon which pull pressure causes the adjuster lock to unlock and permits the length of the rifle butt stock to be lengthened by the pull pressure; and at least one "shorten" surface upon which push pressure causes the adjuster lock to unlock and permits the length of the rifle butt stock to be shortened by the push pressure. In some embodiments there are separate index finger and thumb finger "lengthen" surfaces, separate index finger and thumb finger "shorten" surfaces, and the body and surfaces are dimensioned such that the actuator/adjuster may be operated single handedly. In some embodiments, each surface is ergonomically shaped for its respective finger and the ergonomic shaping of the surfaces may be specific for a left hand or a right hand.

In some embodiments an adjustable length rifle butt stock including an ergonomic unlock actuator/adjuster is provided. In some embodiments, a rifle having an adjustable length rifle butt stock including an ergonomic unlock actuator/adjuster is provided.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

Figure 1:
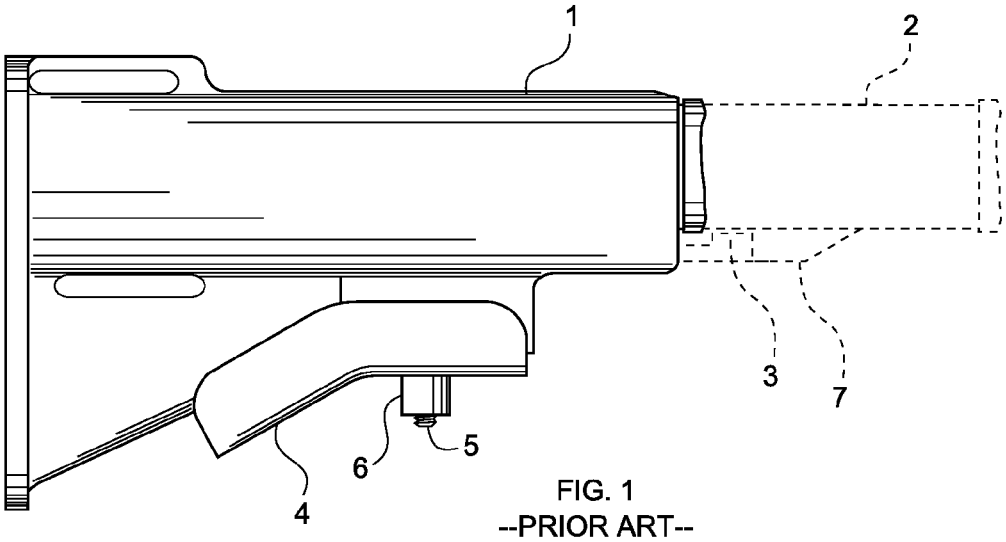
FIGS. 1-4 illustrate prior art rifle butt stocks and adjustment mechanisms.
Figure 2:
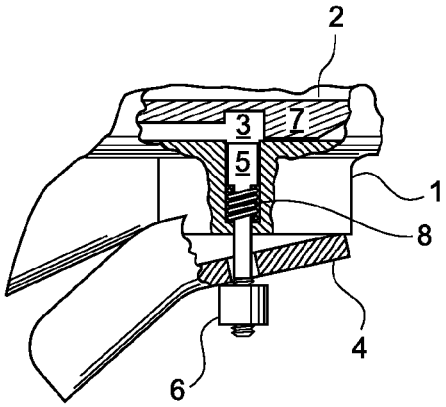
Figure 3:
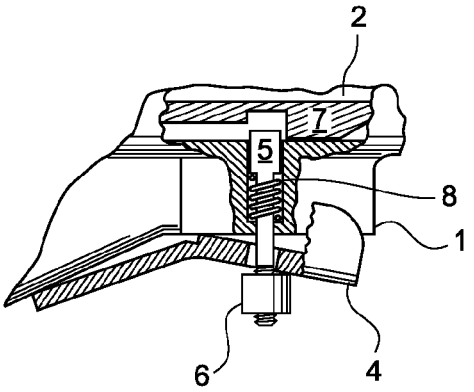
Figure 4:
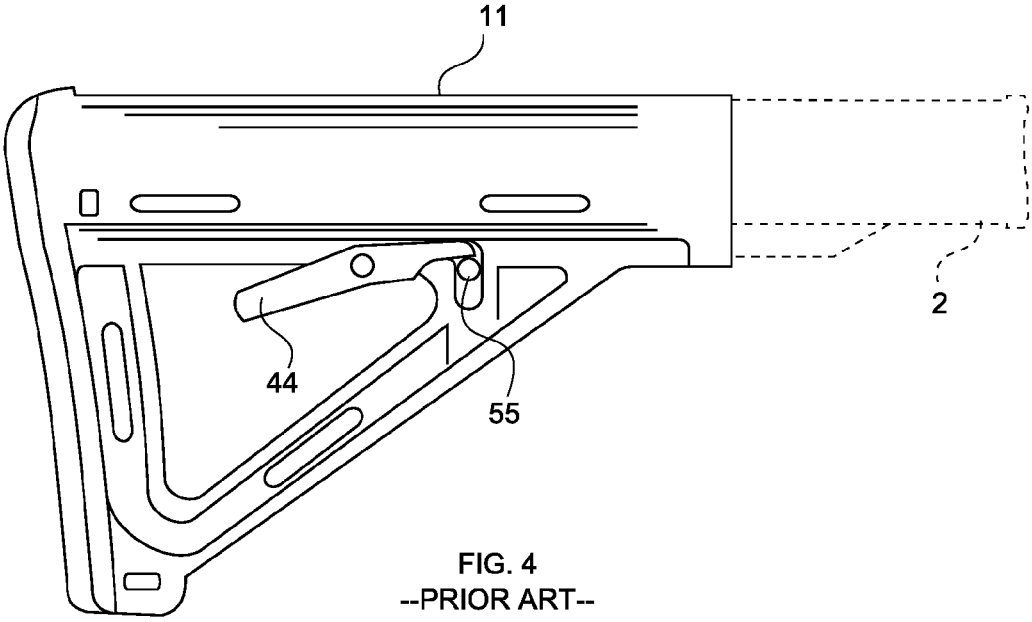
Figure 5:
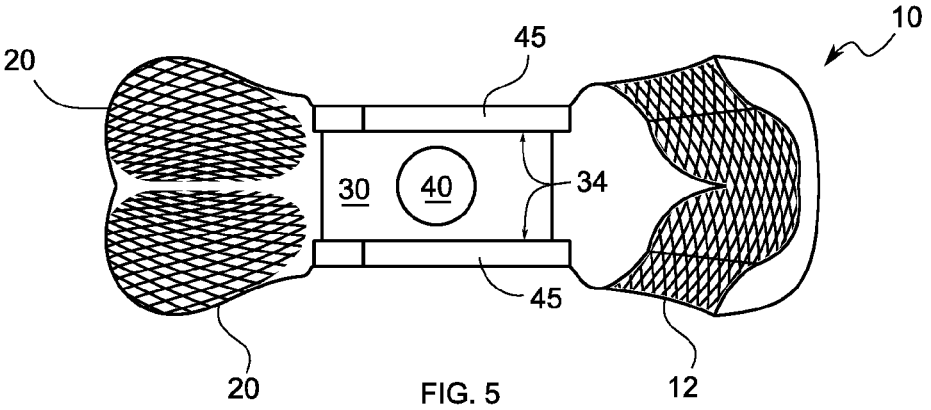
FIGS. 5-9, respectively, are top, bottom, side, front and rear views of an exemplary embodiment in accordance with the present invention.
Figure 6:
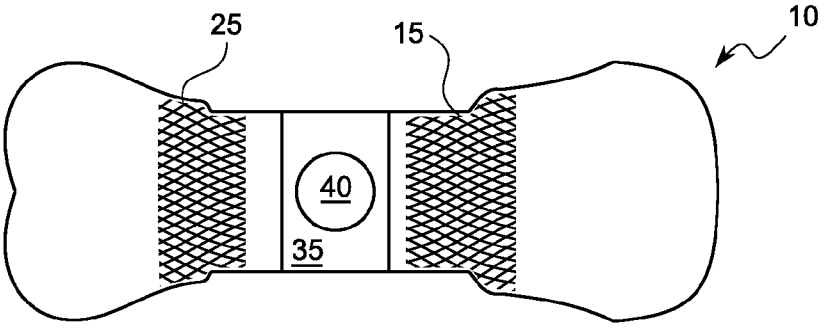
Figure 7:
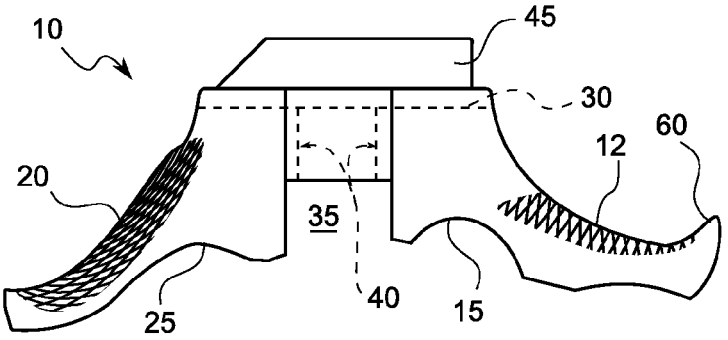
Figure 8:
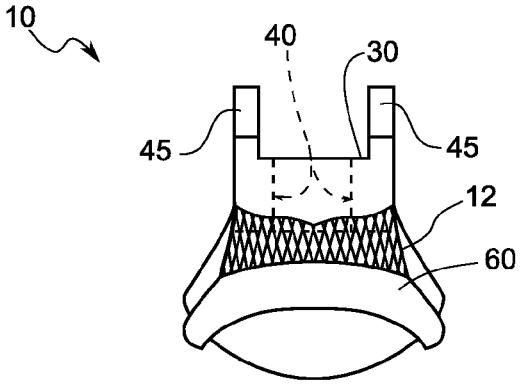
Figure 9:
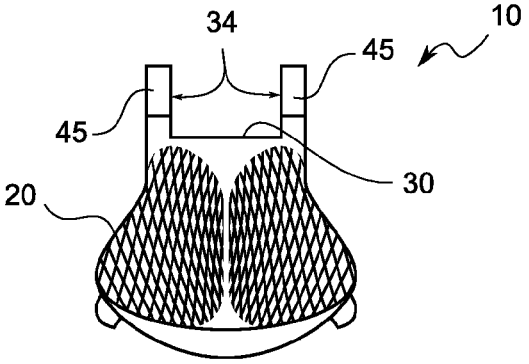

FIGS. 1-3 illustrate one prior art rifle butt stock adjustment actuator as generally disclosed in detail in U.S. Pat. No. 3,348,328 to Roy, the contents of which are hereby incorporated by reference for all purposes. Roy illustrates a telescoping rifle butt stock 1 comprising a receiver extension or buffer tube 2 having a lower rib 7. Extension 2 and rib 7 are configured to be inserted into butt stock 1 and effect slidably variable lengths of the butt stock relative to the rest of the firearm (not shown). The phantom lines in FIG. 1 illustrate, in a central vertical cross section, extension 2 extended from butt stock 1. Referring now to FIGS. 2 and 3, showing a partly broken away and cross-sectional view, the extension 2 may be locked into various degrees of insertion into butt stock 1 by means of recesses 3 (only one shown) in rib 7 engaging with lock pin 5. Lock pin 5 travels vertically in a bore in the butt stock and is pushed into a recess 3 along rib 7 by means of a spring 8 biased to expand in the bore. FIG. 2 illustrates the disengaging action by the pulling of the rear of lever 4 downward, away from the butt stock 1. This pulls nut 6, threaded on to lock pin 5, down, thereby disengaging from recess 3 in receiver tube 2 rib 7, allowing the sliding of receiver tube 2 in or out from butt stock 1. When slid to the desired length, lever 4 is released and spring 8 pushes lock pin 5 into a recess 3 in rib 7. Alternatively, as illustrated in FIG. 3, the rear of lever 4 may be squeezed, effecting a similar disengagement of pin 5 from recess 3. In some implementations, nut 6 is additionally secured to lock pin 5 by means of a set screw in nut 6 (not shown) or lock pin inserted through mated holes in nut 6 and lock pin 5 (not shown).

Referring to FIGS. 5-9, respectively, top, bottom, side, front and rear views of an exemplary embodiment in accordance with the present invention. In this embodiment, the body of a rifle butt stock adjustment actuator 10 includes a U-shaped channel 34 comprising side rails 45 configured to fit to the base of a rifle butt stock. The actuator 10 includes a pair of "pull" finger pressure surfaces—in particular, index finger pressure surface 12 on the top of the forward part of the body and thumb pressure surface area 25 on the bottom of the rear part of the body. The actuator 10 also includes a pair of "push" finger pressure surfaces—in particular, index finger pressure surface 15 on the bottom of the forward part of the body and thumb pressure surface 20 on the top of the rear part of the body. The pressure surfaces may all be ergonomically contoured to fit the portions of an operator's hands contacting such surfaces and contoured to effect the torque needed to pull, e.g., pin 5 (i.e., actuate the unlocking of lock pin 5), and translational pressures needed to operate change (adjust) the length of the rifle. The surfaces may further be textured or treated to provide the operator with tactile information as to which surface is being contacted and to provide friction and anti-slippage during operation. The contouring of index finger pull pressure surface 12 may include lip 60.

Actuator 10 includes further features for linking to the rifle butt stock adjustment mechanism. Actuator 10 may include a bearing surface 30 for contacting the base of the rifle butt stock and through-hole 40 through which a lock pin such as lock pin 5 may be disposed. Additionally, there may be a channel 35 disposed below through-hole 40, sized to accommodate a lock pin nut such as lock pin nut 6 when attached to lock pin 5.

Figure 10:
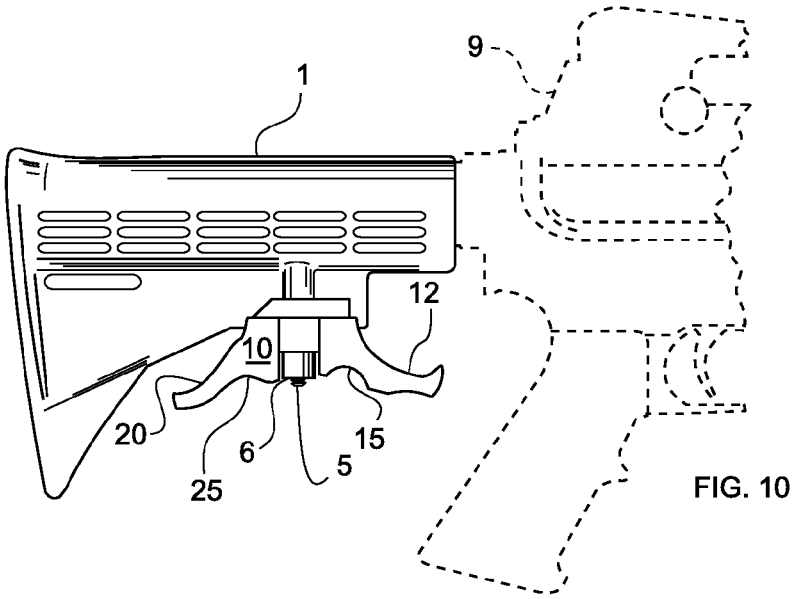
FIGS. 10-12 illustrate various positions of use of an exemplary embodiment of the present invention.
Figure 11:
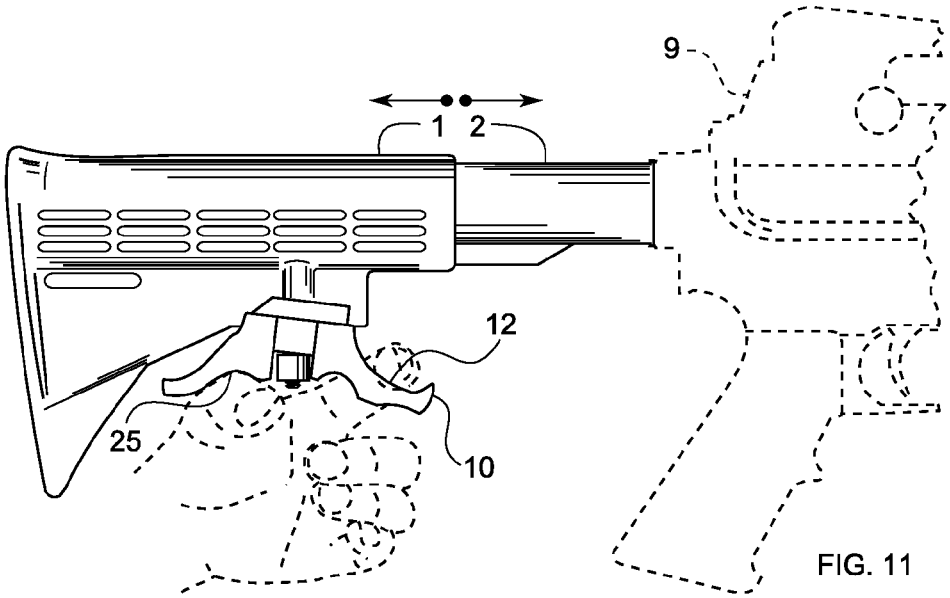
Figure 12:
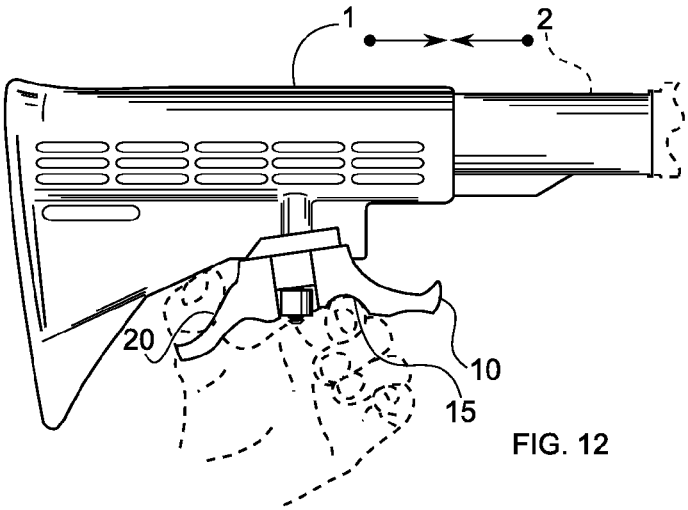
Figure 13:
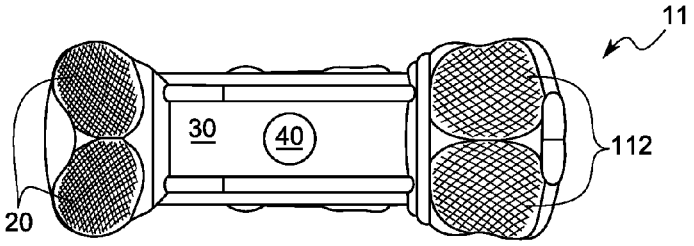
FIGS. 13-17, respectively, are top, bottom, side, perspective and front views of an alternate exemplary embodiment of the present invention.
Figure 14:
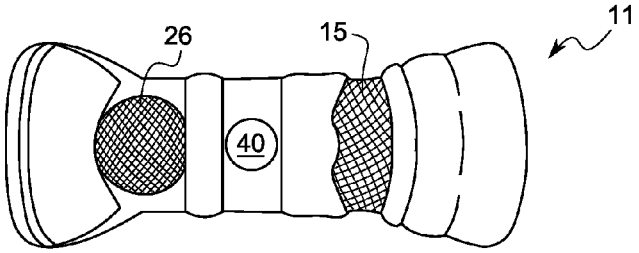
Figure 15:
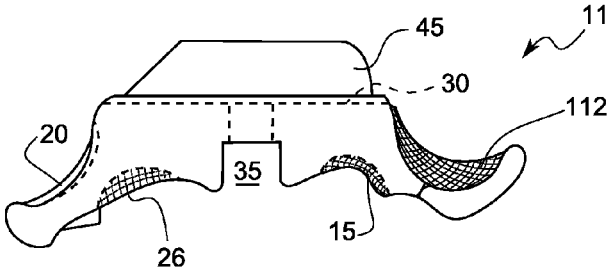
Figure 16:
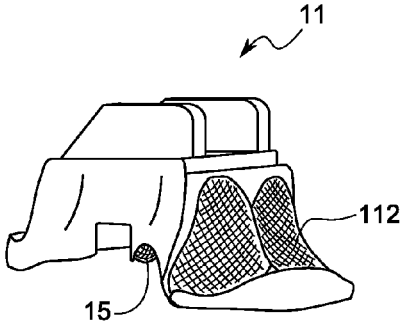
Figure 17:
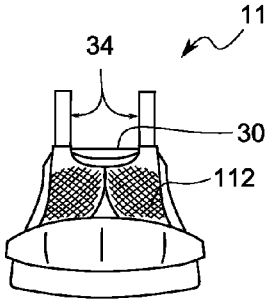

Referring now to FIGS. 10-12, the inventive actuator can be seen in the context of a rifle 9. FIG. 10 illustrates a rifle with a fully collapsed butt stock extension with actuator 10 in a neutral position. FIGS. 11 and 12 illustrate a rifle with an extended butt stock. In FIG. 11, an operator's hand can be seen in phantom outline, with index finger upon pull pressure surface 12 and thumb upon pull pressure surface 25. In this configuration, pressure upon these surfaces torques actuator 10 so that it is levered against butt stock 1 via the rear edge of bearing 30, thereby forcing nut 6 and lock pin 5 downward, thereby unlocking butt stock 1 from receiver extension 2. At the same time, the operator's hand is positioned to pull butt stock 1 rearward, thereby extending the rifle length by the telescoping of receiver extension 2 as illustrated by the arrows. When the operator alleviates pressure, the spring force on pin 5 will pull the actuator 10 back into a neutral position and allowing for the locking of the butt stock 1 to receiver tube 2.

As illustrated in FIG. 12, an operator's hand can be seen in phantom outline, with index figure on push pressure surface 15 and thumb on push pressure surface 20. With pressure upon these surfaces, actuator 10 is torqued so that is levered against butt stock 1 via the front edge of bearing 30, thereby forcing nut 6 and lock pin 5 downward, unlocking butt stock 1 from receiver extension 2. At the same time, the operator's hand is positioned to push butt stock 1 forward, thereby decreasing the rifle length by the sliding of receiver extension 2 into rifle butt stock 1 as illustrated by the arrows. When the operator alleviates pressure, the spring force on pin 5 pulls actuator 10 back into a neutral position and allows for the locking of the butt stock 1 to receiver extension 2.

Referring now to FIGS. 13-17, an alternate embodiment actuator 11 is illustrated. In this alternative embodiment, indented thumb pull pressure surface 26 is substituted for thumb pull pressure surface 25. Indenting of a thumb pull pressure surface may permit the operator to more readily determine seating of the thumb by feel, especially when wearing gloves. Also, in alternate embodiments such as actuator 11, index finger pull pressure surfaces 112 may be substituted for pull pressure surface 12.

Figure 18:
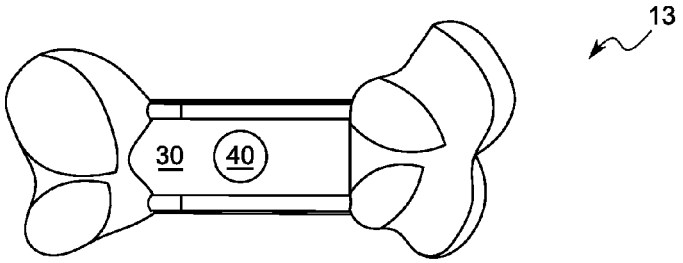
FIGS. 18 and 19 illustrate, in top view, third and fourth alternate exemplary embodiment in accordance with the present invention.
Figure 19:
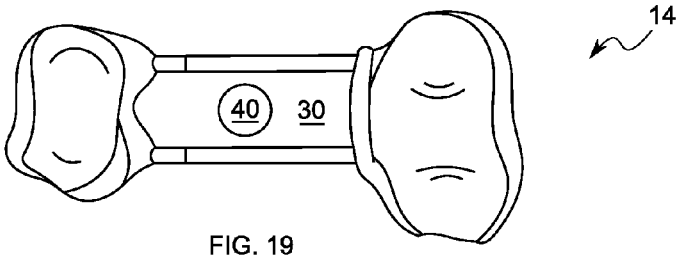

Referring now to FIGS. 18 and 19, alternate embodiments are illustrated for operating hand dominance. That is, the contours and sizes of the pressure surfaces are optimized for the hand that will operate the actuators 13 or 14. Thus, if the operator uses the right hand for the rifle's pistol grip and trigger, the pressure surfaces of actuators 13 or 14 are optimized for the left hand. Conversely, if the operator uses the left hand for the rifle's pistol grip and trigger, the pressure surfaces of actuators 13 or 14 are optimized for the right hand. Similar to the embodiments of actuators 10 and 11, actuators 13 and 14 may include a bearing surface 30 and lock pin through-hole 40.

Actuators in accordance with the invention, such as actuators 10, 11, 13 and 14, may be manufactured through machining of metals such as aluminum and titanium or light weight alloys. Alternatively, actuators may be cast metal with machining as needed to produce surface features. Alternatively, actuators may be molded plastics. Further, actuators may be 3D printed. This is particularly advantageous for customizing the size and shape of the hand contact surfaces of the actuator for a particular operator's hand. Such printing may be in the various plastics adapted to 3D printing or various metals used in 3D printing processes such as direct metal laser sintering.

It should be emphasized that the above-described embodiments of the present disclosure are merely possible examples of implementations set forth for a clear understanding of the principles of the disclosure. Many variations and modifications may be made to the above-described embodiments without departing substantially from the spirit and principles of the disclosure. All such modifications and variations are intended to be included herein within the scope of this disclosure and protected by the patent's claims.

What is claimed is:

1. A rifle butt stock adjustment actuator comprising:

a body with a U-channel configured to fit a base of a telescoping rifle butt stock and operably connect to a butt stock adjustment mechanism;

a push pair of ergonomically shaped finger pressure surfaces disposed on the body;

a pull pair of ergonomically shaped finger pressure surfaces disposed on the body;

wherein, when attached to the base of a telescoping rifle butt stock and operably connected to the butt stock adjustment mechanism:

pressure applied to the push pair of pressure surfaces actuates the butt stock adjustment mechanism and telescopes the rifle butt stock into a shorter configuration; and pressure applied to the pull pair of pressure surfaces actuates the butt stock adjustment mechanism and telescopes the rifle butt stock into a shorter configuration.

2. The rifle butt stock adjustment actuator of claim 1 wherein a rear one of the pull pair of pressure surfaces is indented into the body.

3. The rifle butt stock adjustment actuator of claim 1 wherein the size and shape of the ergonomically shaped finger pressure surfaces are optimized for one of a left hand or a right hand.

4. The rifle butt stock adjustment actuator of claim 1 wherein a front one of the pull pair of pressure surfaces terminates in a forward-edge lip.

5. The rifle butt stock adjustment actuator of claim 1 wherein the pressure surfaces comprise an anti-slip surface treatment.

6. The rifle butt stock adjustment actuator of claim 5 wherein the anti-slip surface treatment is surface knurling.

7. The rifle butt stock adjustment actuator of claim 1 wherein at least one pressure surface comprises a tactile feature for identifying the surface by feel.

8. An unlock actuator/adjuster for an adjustable length rifle butt stock, said unlock actuator/adjuster comprising a body operably connected to a rifle butt stock length adjuster lock, said body comprising:

at least one "lengthen" surface, wherein pull pressure thereon causes the adjuster lock to unlock while permitting the length of the rifle butt stock to be lengthened by said pull pressure; and at least one "shorten" surface, wherein push pressure thereon causes the adjuster lock to unlock while permitting the length of the rifle butt stock to be shortened by said push pressure;

wherein the at least one "lengthen" surface comprises separate index finger and thumb finger surfaces, the at least one "shorten" surface comprises separate index finger and thumb finger surfaces, and said body and surfaces are dimensioned to be operated by the thumb finger and index finger of a single hand.

9. The unlock actuator/adjuster of claim 8, wherein each said surface is ergonomically shaped for its respective said finger.

10. The unlock actuator/adjuster of claim 9, wherein the ergonomic shaping of said surfaces is specific for one of a left hand or a right hand.

11. An adjustable length rifle butt stock comprising the unlock actuator/adjuster of claim 9.

12. A rifle comprising the adjustable-length rifle butt stock of claim 11.

* * * * *